United States Patent [19]

Sgarlato et al.

[11] 4,100,686

[45] Jul. 18, 1978

[54] SHOE SOLE CONSTRUCTION

[76] Inventors: Thomas E. Sgarlato, 354 Bachman Ave., Los Gatos, Calif. 95030; Gary A. Eston, 420 Maple St., Redwood City, Calif. 94063; Thomas E. Freeman, 100 Arch St., Redwood City, Calif. 94062

[21] Appl. No.: 830,690

[22] Filed: Sep. 6, 1977

[51] Int. Cl.[2] ..... A63B 21/00

[52] U.S. Cl. ..... 36/29; 36/44

[58] Field of Search ..... 36/29, 44, 28

[56] References Cited

U.S. PATENT DOCUMENTS

| | | | |
|---|---|---|---|
| 580,501 | 4/1897 | Mobberley | 36/29 |
| 2,084,517 | 6/1937 | Vogel | 36/29 X |
| 2,677,906 | 5/1954 | Reed | 36/44 X |
| 3,160,963 | 12/1964 | Aaskov | 36/29 X |
| 3,253,355 | 5/1966 | Menken | 36/29 |
| 3,765,422 | 10/1973 | Smith | 36/29 X |

FOREIGN PATENT DOCUMENTS

| | | | |
|---|---|---|---|
| A58,865 | 4/1954 | France | 36/29 |

*Primary Examiner*—Alfred R. Guest

*Attorney, Agent, or Firm*—Robert Charles Hill

[57] ABSTRACT

A shoe sole construction is provided with a flexible bladder which is only partially filled with a non-compressible fluid. Preferably the fluid is water. The partially filled water bladder allows the water to flow from one portion of the bladder to other portions of the bladder during the walking cycle to provide proper support and maximum comfort and stability for the wearer of the shoe.

8 Claims, 7 Drawing Figures

SHOE SOLE CONSTRUCTION

BACKGROUND OF THE INVENTION

This invention relates generally to a shoe construction. More particularly the invention relates to a shoe construction having a new and useful sole construction utilizing a bladder which is partially filled with water to cushion and therapeutically support the wearer's foot.

The prior art has recognized that the use of insoles for enhancing foot comfort and reducing shocks transmitted to the feet is desirable. Many prior art shoe constructions have utilized rubber or sponge-like insoles. Still other prior art shoe constructions have utilized air or water under pressure in the sole of shoes.

All of these prior art constructions have disadvantages which are overcome by the present invention. For example, a major disadvantage of rubber-like insoles is that they tend to take a permanent set after extended use, thereby reducing their cushioning effect. The aforementioned prior art sole constructions utilizing air or water under pressure have the disadvantage of providing a resting surface that, though cushioned by fluid under pressure, is not stable during critical phases of the walking cycle so that the wearer does not maintain a proper sense of balance.

The primary object of the present invention is to provide a shoe sole construction with a flexible bladder having a cavity therein which is only partially filled with water so that the water may freely flow throughout the cavity during the walking cycle.

A further object of the present invention is to provide a relatively inexpensive sole structure which comfortably cushions and supports the user's feet when wearing footwear.

Yet another object of the present invention is to provide a sole structure which has a therapeutic effect upon the feet of the user and which further provides a gentle propulsive force to aid in the walking cycle.

A still further object is to provide a sole structure having a partially filled water bladder which is built into and made an integral part of the footwear.

Other objects, novel features and advantages of the present invention will become apparent upon making reference to the following detailed description and the accompanying drawings. The description and drawings will also further disclose the characteristics of this invention, both as to its structure and mode of operation. Although preferred embodiments of the invention are described hereinbelow, and shown in the accompanying drawing, it is expressly understood that the descriptions and drawings thereof are for the purpose of illustration only and do not limit the scope of this invention.

DESCRIPTION OF THE PREFERRED EMBODIMENT

Figure 1:
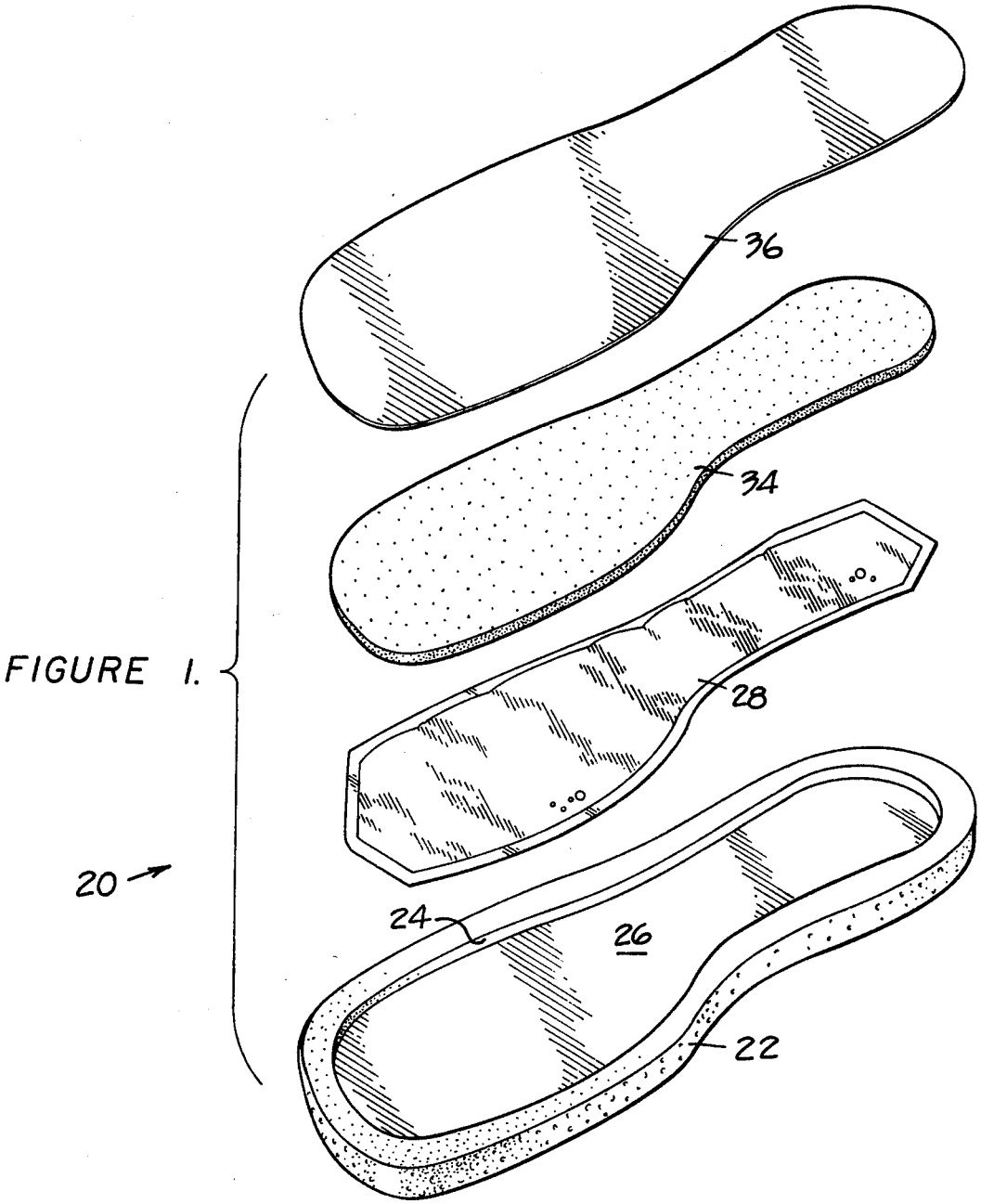
FIG. 1 is an exploded view which illustrates the component parts of the shoe sole construction of the present invention.
Figure 2:
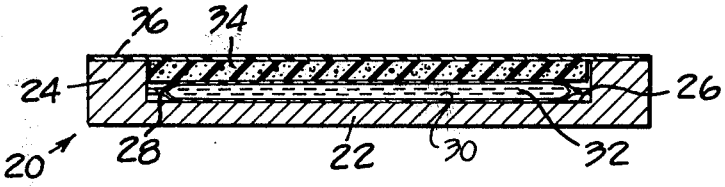
FIG. 2 is a lateral cross-sectional view of the shoe sole construction of the present invention.

Referring now to FIGS. 1 and 2, there is shown a preferred embodiment of the shoe construction of the present invention. The shoe construction of the present invention comprises a composite sole construction shown generally at 20 which can be secured to conventional shoe uppers (not shown) or form the base of a relatively simple sandal. The sole construction 20 comprises a lower sole member 22 which is preferably made of leather or a suitable synthetic material. The lower sole member 22 is provided with raised side walls 24 which extend about the entire periphery of the lower sole to define a recessed area or space 26.

A flexible bladder 28 which defines a fluid tight cavity 30 is disposed within the recessed area 26 and is confined therein by the side walls 24 of the lower sole 22. The flexible bladder is preferably constructed of two thin strips of vinyl material which are sealed to each other around the edges thereof such as by heat sealing or other suitable means. The fluid tight cavity 30 contains a volume of water 32 which only partially fills the cavity. For reasons which will be more fully explained at a later point in the description, the volume of water should not exceed 75% of the cavity capacity and preferably should be in a range of from 20%-60% of the cavity capacity depending upon the shoe size so that water may freely flow from one end of the cavity to the other end of the cavity.

A flexible liner 34 is shaped to the contour of the lower sole recessed area 26 and fits therein immediately above the bladder 28. The liner 34 is preferably constructed of a closed cell neoprene material because same has excellent durability and does not absorb and hold moisture generated by foot perspiration. As will be better understood at a later point in the description, the flexible liner 34 performs an important function in that it provides an additional cushioning factor and serves to dampen the effect of the water flowing from one portion of the bladder cavity 30 to another to thereby prevent undesirable slushing action within the bladder cavity.

An upper insole member 36 extends over the top of the flexible liner 34 and is fixedly secured to the side walls 24 of the lower sole member as by adhesive bonding or the like. The upper insole 36 may be constructed of leather or a suitable synthetic. It should be noted that the upper insole is relatively thin and is flexible.

Referring now to schematic FIGS. 3 - 7, the unique advantages of the partially filled water bladder 28 are clearly illustrated with respect to cushioning of the foot and increased heel-toe function due to water flow within the bladder during the walking cycle.

Figure 3:
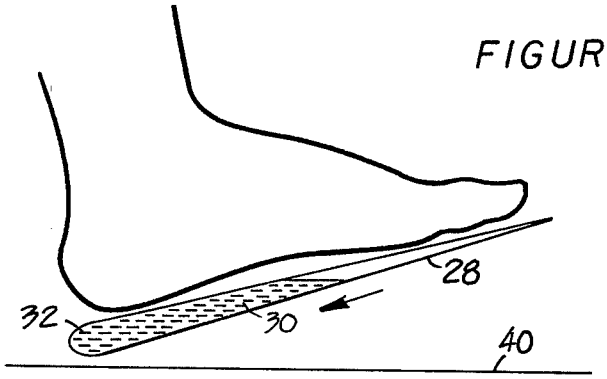
FIGS. 3 - 7 are schematic illustrations showing the flow of water in the shoe bladder during the various stages of a walking cycle.

FIG. 3 shows the walking phase just prior to heel contact with the surface 40. The partially filled water bladder 28 is shown with more water 32 under the heel area, having flowed in the direction of the arrow due to momentum of the leg and the force of gravity.

Figure 4:
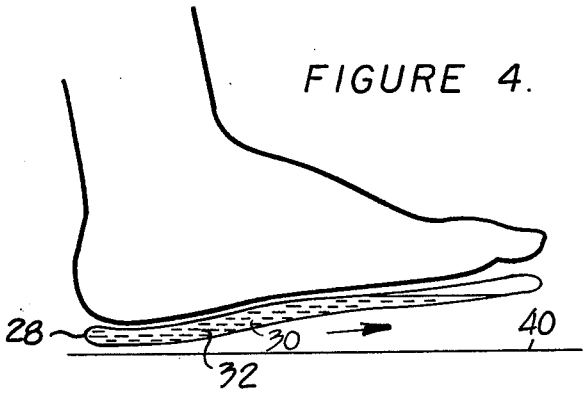

FIG. 4 shows the heel contact phase of the walking cycle. In this phase, the water 32 cushions the heel strike and then due to vertical compression of the heel upon the bladder 28 the water 32 is forced to flow forward (in the direction of the arrow) under the arch and then under the ball of the foot to thus cushion the impact of the forefoot as it comes into contact with surface 40.

Figure 5:
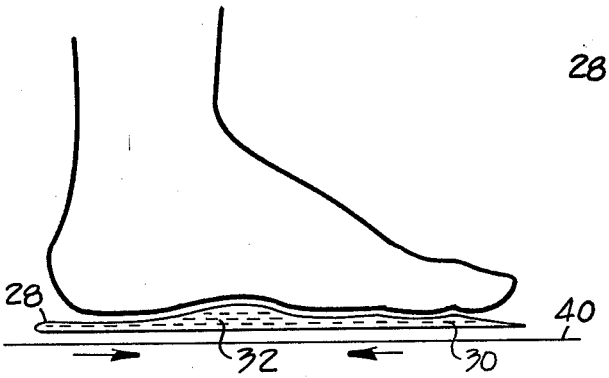

FIG. 5 shows the mid-stance phase of the walking cycle where the leg has moved to a vertical position with respect to the foot. In this phase, the water 32 flows away from both the heel and toe areas of the foot (note the arrows) and the water is positioned in that portion of the bladder 28 directly beneath the arch of the foot, thereby cushioning the arch and facilitating the normal balancing of the foot. Actually the balance of the wearer is increased because more of the plantar surface of the foot is weight bearing. This leads to a further advantage in that the leg muscles are assisted in decelerating internal leg rotation and accelerating external leg rotation which should occur during this phase.

Figure 6:
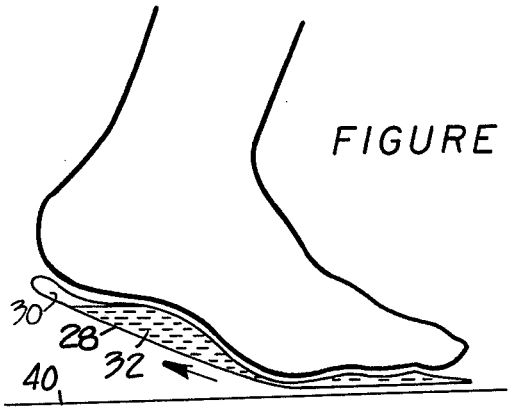

FIG. 6 shows the heel elevation stage of the walking cycle. In this phase, as foot weight is transmitted forwardly, the heel is elevated and the water 32 flows back towards the heel facilitating the heel elevation. This water flow under the heel also creates a stable and active propulsive phase to the walking cycle with greater toe function.

Figure 7:
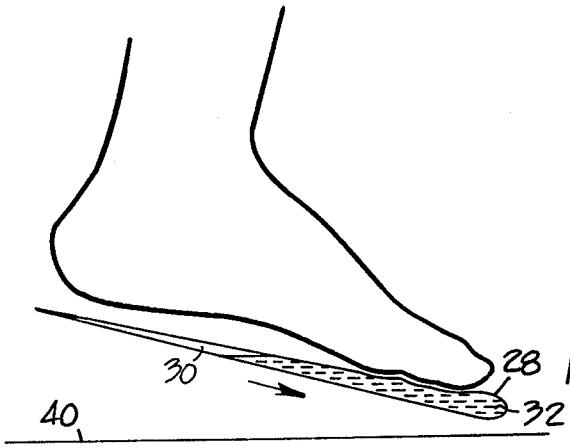

FIG. 7 shows the toe-off phase of the walking cycle. In this phase, the water 42 begins to slowly flow forward toward the front or ball of the foot because of foot momentum and gravity.

It is apparent that the embodiment of the invention which has been described above has been given by way of illustration and not by way of limitation and that same is capable of many variations and modifications within the basic scope of the invention and within the scope of the appended claims.

What is claimed is:

1. A shoe construction comprising:

(a) a sole means defining a recessed area;

(b) a flexible bladder defining a fluid tight cavity, said bladder disposed within said recessed area; and (c) a volume of liquid disposed within and only partially filling said fluid tight bladder cavity whereby liquid may freely flow from one portion of said cavity to another portion of said cavity.

2. A shoe construction as set forth in claim 1 wherein said sole means comprises a lower sole member having raised side walls defining said recessed area; and an upper insole member extending over said recessed area and fixedly secured to said side walls.

3. A shoe construction as set forth in claim 2 wherein said volume of water occupies less than 75% of said bladder cavity.

4. A shoe construction as set forth in claim 3 wherein said volume of liquid occupies less than 75% of said bladder cavity.

5. A shoe construction as set forth in claim 4 wherein said flexible liner is constructed of a closed cell neoprene material and said bladder is constructed of a thin vinyl material.

6. A shoe construction as set forth in claim 1 wherein said volume of liquid comprises water and occupies less than 75% of said bladder cavity.

7. A shoe construction as set forth in claim 2 wherein said volume of liquid occupies less than 75% of said bladder cavity.

8. A shoe construction as set forth in claim 1 wherein said volume of liquid comprises water and occupies 20% to 60% of said bladder cavity.

* * * * *